US007309212B2

(12) United States Patent
Itzel et al.

(10) Patent No.: US 7,309,212 B2
(45) Date of Patent: Dec. 18, 2007

(54) GAS TURBINE BUCKET WITH COOLED PLATFORM LEADING EDGE AND METHOD OF COOLING PLATFORM LEADING EDGE

(75) Inventors: Gary Michael Itzel, Simpsonville, SC (US); Waylon Willard Webbon, Greenville, SC (US)

(73) Assignee: General Electric Company, Schenectady, NY (US)

( * ) Notice: Subject to any disclaimer, the term of this patent is extended or adjusted under 35 U.S.C. 154(b) by 81 days.

(21) Appl. No.: 11/282,704

(22) Filed: Nov. 21, 2005

(65) Prior Publication Data

US 2007/0116574 A1 May 24, 2007

(51) Int. Cl.
*F01D 5/18* (2006.01)

(52) U.S. Cl. ..... 416/193 A

(58) Field of Classification Search ..... 416/193 A
See application file for complete search history.

(56) References Cited

U.S. PATENT DOCUMENTS

| | | | | |
|---|---|---|---|---|
| 5,344,283 | A * | 9/1994 | Magowan et al. | 415/115 |
| 5,382,135 | A | 1/1995 | Green | |
| 5,536,143 | A | 7/1996 | Jacala et al. | |
| 5,639,216 | A | 6/1997 | McLaurin et al. | |
| 5,813,835 | A * | 9/1998 | Corsmeier et al. | 416/97 R |
| 5,848,876 | A * | 12/1998 | Tomita | 416/96 R |
| 6,019,579 | A | 2/2000 | Fukuno et al. | |
| 6,071,075 | A | 6/2000 | Tomita et al. | |
| 6,079,946 | A * | 6/2000 | Suenaga et al. | 416/97 R |
| 6,120,249 | A | 9/2000 | Hultgren et al. | |
| 6,132,173 | A | 10/2000 | Tomita et al. | |
| 6,190,130 | B1 * | 2/2001 | Fukue et al. | 416/97 R |
| 6,196,799 | B1 * | 3/2001 | Fukue et al. | 416/97 R |
| 6,309,175 | B1 | 10/2001 | Hahnle et al. | |
| 6,390,774 | B1 | 5/2002 | Lewis et al. | |
| 6,416,284 | B1 | 7/2002 | Demers et al. | |
| 6,422,817 | B1 | 7/2002 | Jacala | |
| 6,431,833 | B2 | 8/2002 | Jones | |
| 6,481,967 | B2 | 11/2002 | Tomita et al. | |
| 6,506,020 | B2 | 1/2003 | Dailey | |
| 6,641,360 | B2 | 11/2003 | Beeck et al. | |
| 6,805,534 | B1 | 10/2004 | Brittingham | |
| 2001/0021343 | A1 * | 9/2001 | Kuwabara et al. | 415/115 |

FOREIGN PATENT DOCUMENTS

| | | |
|---|---|---|
| EP | 0 789 806 | 7/1998 |
| EP | 0 777 818 | 10/1998 |
| EP | 0 937 863 | 4/2000 |
| EP | 0 866 214 | 6/2003 |
| EP | 1 087 102 | 1/2004 |
| EP | 1 514 999 | 3/2005 |
| JP | 10252406 | 9/1998 |
| JP | 2001090501 | 4/2001 |

* cited by examiner

*Primary Examiner*—Richard A. Edgar
(74) *Attorney, Agent, or Firm*—Nixon & Vanderhye PC

(57) ABSTRACT

In a turbine bucket having an airfoil portion and a root portion with a substantially planar platform at an interface between the airfoil portion and the root portion, a platform cooling arrangement including a cavity extending along the forward portion of the platform, and at least one inlet bore extending from a source of cooling medium to the cavity, and at least one outlet opening for expelling cooling medium from the cavity.

14 Claims, 4 Drawing Sheets

GAS TURBINE BUCKET WITH COOLED PLATFORM LEADING EDGE AND METHOD OF COOLING PLATFORM LEADING EDGE

BACKGROUND OF THE INVENTION

This invention relates to the cooling of turbine buckets and, specifically, to the cooling of the platform region of the bucket, at the leading edge of the bucket.

BRIEF DESCRIPTION OF THE INVENTION

Over the years, gas turbine firing temperatures have been increasing in order to improve turbine efficiency and output. As firing temperatures increase, bucket platforms, which in the past have been un-cooled, exhibit distress, such as oxidation, low cycle fatigue and creep. Film cooling has been used more recently to help cool the platforms, but film cooling is generally limited to the aft portions of the platform where the gas path flow has been accelerated sufficiently to drop the static pressure to a level where there is sufficient supply pressure to have positive film flow without hot gas ingestion. Platform leading edges are in a region where there is insufficient pressure to utilize film cooling but is also a region where there is distress due to high temperatures.

The present invention provides a unique solution to the above problem by actively cooling the bucket platform leading edge such that the bucket meets life requirements while minimizing the impact on engine performance. Active cooling is provided by directing cooling media to a cavity extending along the platform leading edge. Thus, the invention may be embodied in a turbine bucket having an airfoil portion and a root portion with a substantially planar platform at an interface between the airfoil portion and the root portion, a platform cooling arrangement including a cavity extending along the forward portion of the platform, at least one inlet bore extending from a source of cooling medium to said cavity and at least one outlet opening for expelling cooling medium from said cavity.

The invention may also be embodied in a method of cooling a leading edge of a turbine bucket having an airfoil portion and a root portion, said airfoil portion being joined to a platform extending over said root portion, comprising: forming a cavity to extend along and adjacent at least a portion of said leading edge; flowing a cooling medium from a source of cooling medium through at least one inlet bore to said cavity; and expelling cooling medium from said cavity through said at least one outlet opening.

DETAILED DESCRIPTION OF THE INVENTION

The leading edges of bucket platforms have begun to exhibit distress such as oxidation, low cycle fatigue and creep as firing temperatures have increased. There is insufficient cooling pressure ratio to film cool the bucket platform leading edge. Therefore, in an example embodiment of the invention, active cooling is provided to eliminate oxidation, low cycle fatigue and creep distress on the bucket platform leading edge. The cooling medium flow is fed through a cast cavity, machined cavity or a drilled hole which runs along the forward portion of the bucket platform.

Figure 1:
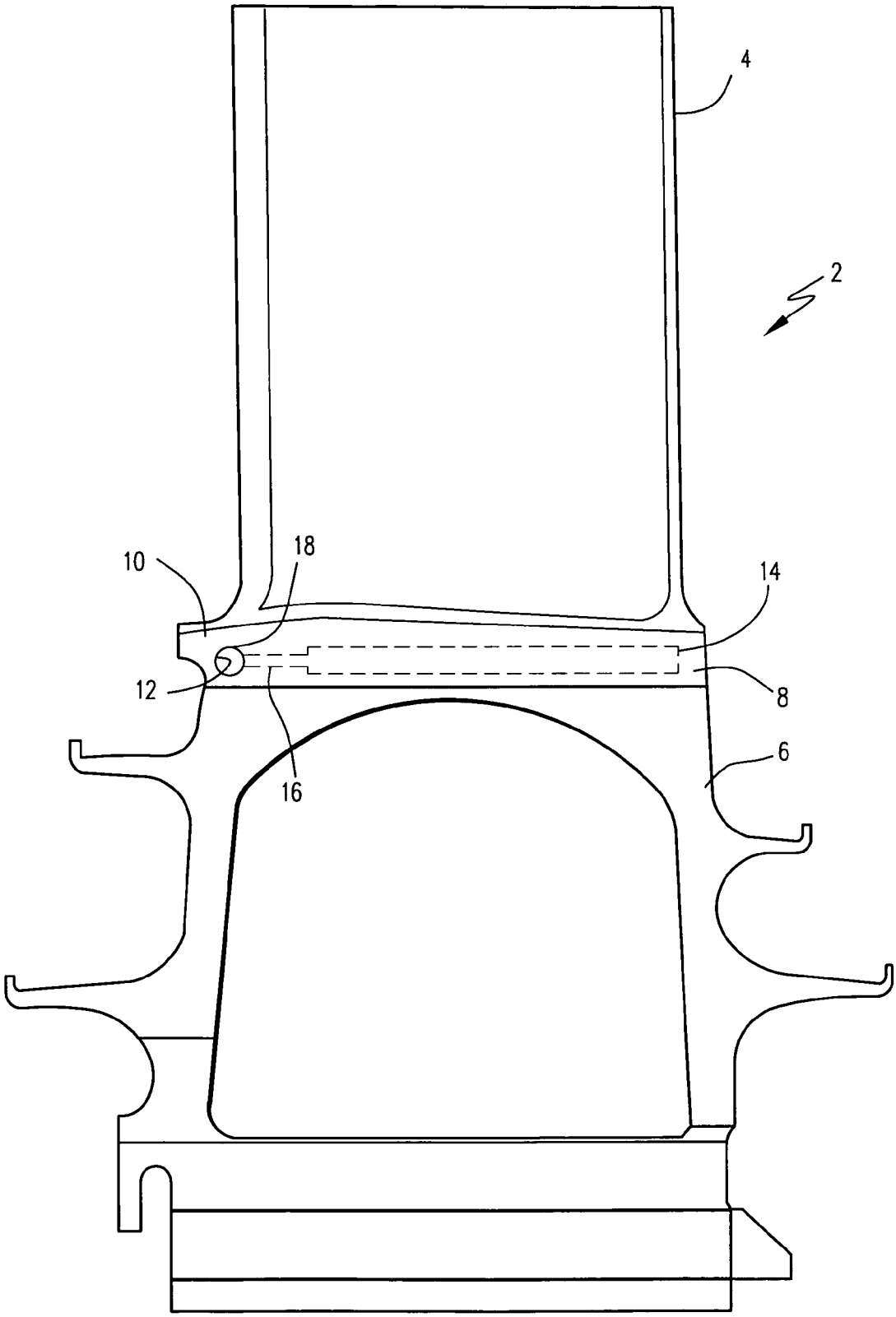
FIG. 1 is a schematic, partial side cross-section of a bucket in an example embodiment of the invention.
Figure 2:
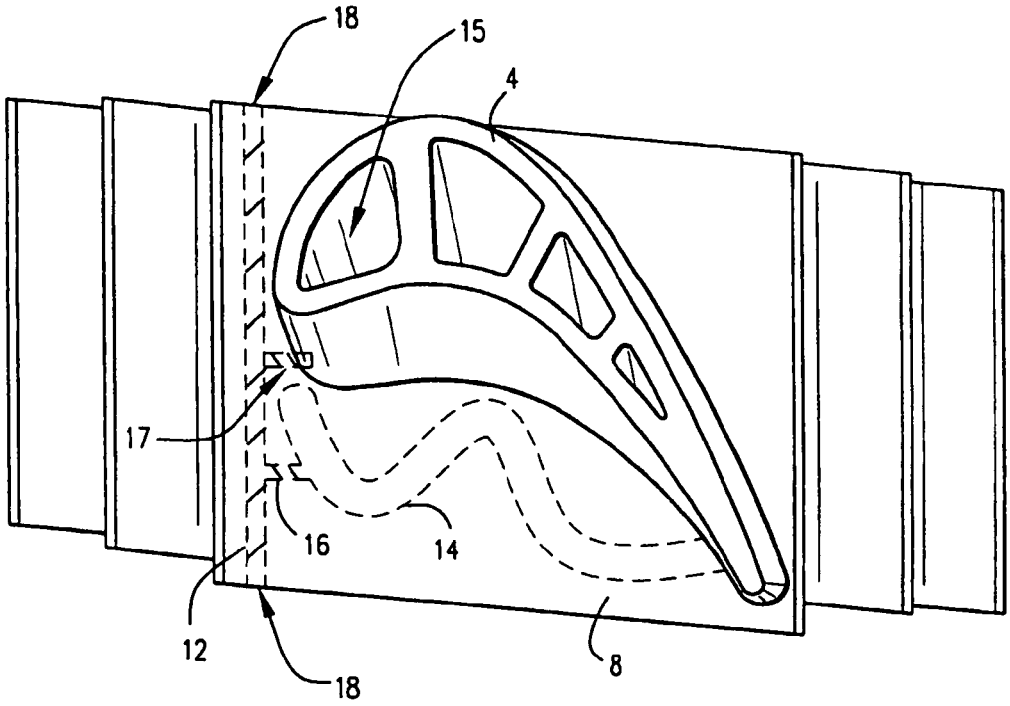
FIG. 2 is a top plan view of the bucket of FIG. 1.

As an example embodiment, FIGS. 1 and 2 illustrate a turbine bucket 2 having an airfoil portion 4 and a root portion 6 with a substantially planar platform 8 at an interface between the airfoil portion and the root portion. A cooling media, such as cooling steam, is supplied from the bucket cooling circuit (schematically shown at 15) or platform cooling circuit (schematically shown at 14) to a forward cavity 12 that has been cast, machined or drilled in the forward portion of the bucket platform. Examples of cooling circuits that may serve as a source for the cooling medium in the example embodiment of FIGS. 1-2 include the cooling circuits disclosed in U.S. Pat. Nos. 6,422,817, 6,390,774 and 5,536,143 the disclosures of which are incorporated herein by this reference. The coolant is supplied to the forward cavity through one or more passages or bores 16 or 17 connecting this cavity 12 to the airfoil steam circuit 15 or the pressure side platform cooling circuit 14, as schematically illustrated. In this example embodiment, the high velocity steam directed to the forward cavity 12 generates high heat transfer and convection cooling. Cooling may be enhanced with bumps, dimples (hereinafter generically referred to as turbulators) in passages(s) 16, 17 or cavity 12 to further augment convection cooling. These turbulators are schematically illustrated in FIG. 2 with hatch marks in cavity 12 and passages 16, 17.

After the steam has been used to convectively cool the platform leading edge 10, the steam is expelled through at least one opening. In the illustrated embodiment, the exit openings 18 are defined on the bucket slash face at each longitudinal end of the cooling cavity 12. The expelled steam impinges on the adjacent bucket slash face, thereby cooling the adjacent bucket slash face as well. The coolant steam then purges the gap between the buckets, reducing the amount of hot gas path air entering the gap between buckets. This is possible with steam due to the steam pressure being much greater than the gas path pressure.

Figure 3:
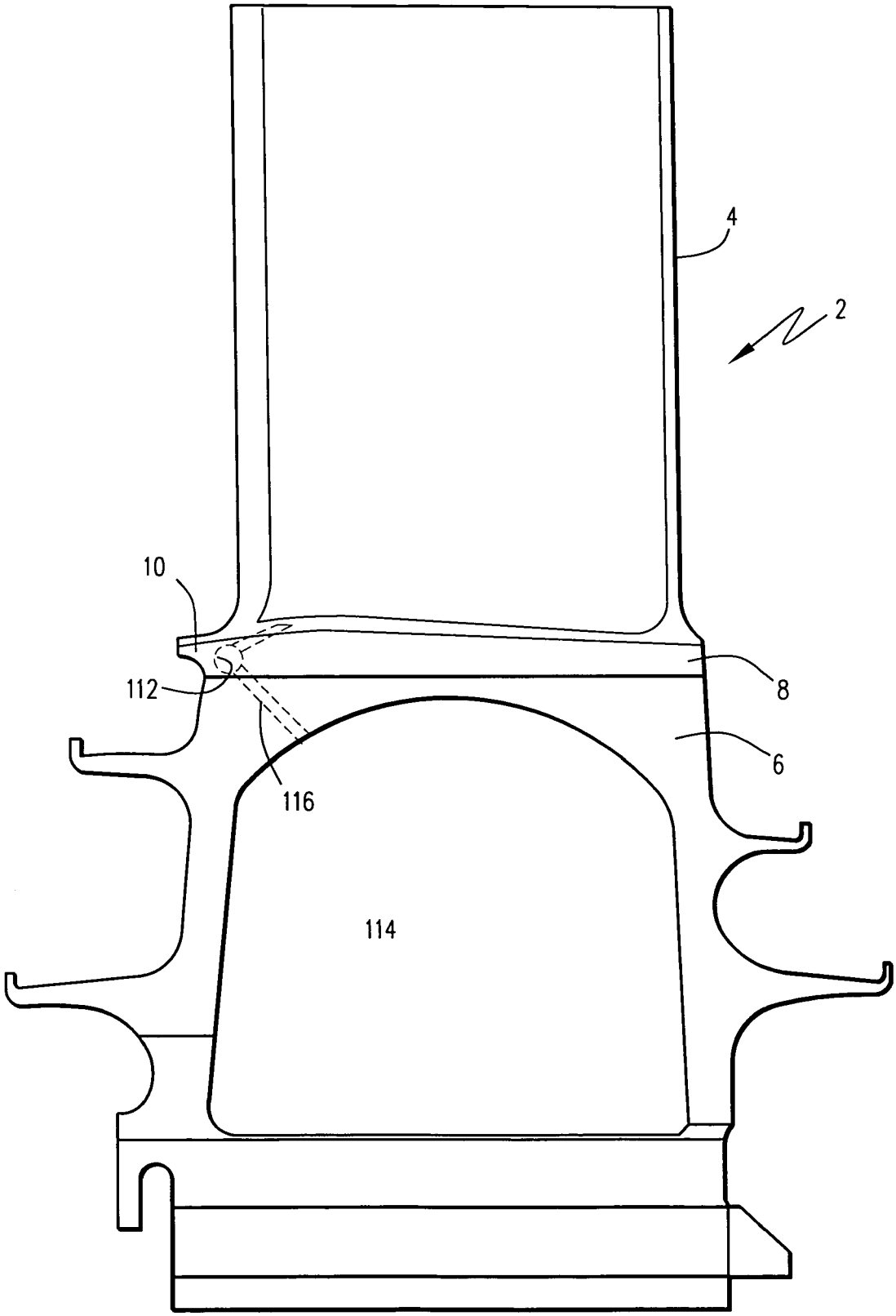
FIG. 3 is a schematic, partial side cross-section of a bucket according to another example embodiment of the invention.
Figure 4:
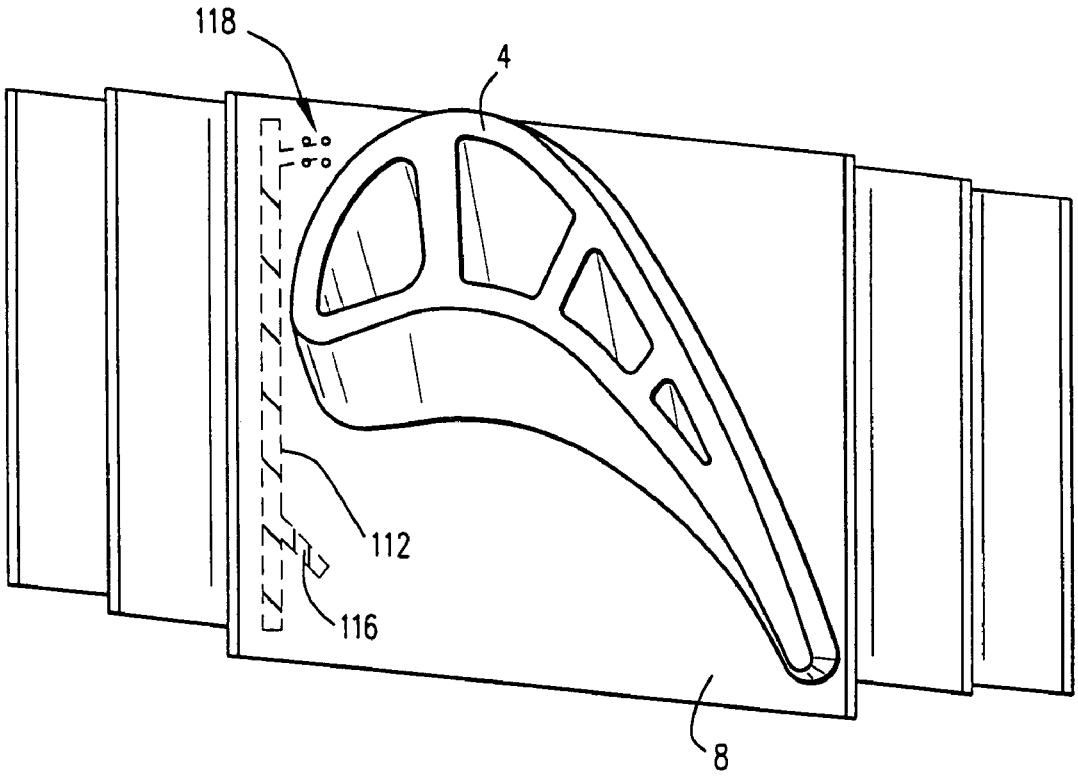
FIG. 4 is a top plan view of the bucket of FIG. 3.

Another example embodiment of the invention is illustrated in FIGS. 3 and 4. As in the embodiment of FIGS. 1 and 2, a cast cavity, machined cavity or a drilled hole is defined to run along the forward portion 10 of the bucket platform 8 thereby defining a forward cavity 112. In this example embodiment, compressor discharge air is fed via a hole or holes 116 drilled or otherwise formed to extend from the bucket shank pocket 114 to supply the cavity 112. U.S. Pat. No. 6,431,833, the disclosure of which is incorporated herein by this reference, discloses the supply of cooling air to the shank pocket. The high velocity air through the forward cavity 112 generates high heat transfer and convection cooling. As in the FIG. 1-2 embodiment, heat transfer can be further enhanced with turbulators, to augment the convection cooling. These turbulators are schematically illustrated in FIG. 4 with hatch marks in cavity 112 and passage 116.

After the air has been used to convectively cool the platform leading edge, the air exits via at least one exit opening. Opening may be provided at the longitudinal end(s) of the cavity. In addition or in the alternative, the exit opening(s) may include film holes 118 that extend through the platform to the suction side of the airfoil 4, where the gas path static pressure is low enough to drive flow through the circuit. These film holes cool the leading edge suction side portion of the platform 8. The air that exits the film holes 118 generates a layer of cool air which further insulates the platform 8 suction side from the hot gas path air. The platform gas path could also be coated with TBC, thermal barrier coating, applied in order to further reduce the heat flux into the platform.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket having an airfoil portion and a root portion with a substantially planar platform at an interface between the airfoil portion and the root portion, a platform cooling arrangement including a cavity extending along the forward portion of the platform, forward of a leading edge of said airfoil portion and continuously from a pressure side to a suction side of said airfoil portion, at least one inlet bore extending from a source of cooling medium to said cavity and at least one outlet opening for expelling cooling medium from said cavity, wherein said at least one outlet opening comprises an exit opening defined at at least one longitudinal end of said cavity.

2. A turbine bucket as in claim 1, wherein said cavity is one of a cast-in cavity, a machined cavity and drilled hole.

3. A turbine bucket as in claim 1, wherein said cavity extends substantially in parallel to a leading edge of said platform.

4. A turbine bucket as in claim 1, wherein said cooling medium comprises steam and said source of cooling medium comprises a cooling circuit defined through one of said airfoil portion and said platform.

5. A turbine bucket as in claim 1, wherein said cooling medium comprises air and said cooling medium source comprises a pocket defined in said root portion.

6. A turbine bucket as in claim 1, wherein said exit opening is defined in a slash face of the platform and is directed to impinge upon a slash face of an adjacent bucket, thereby cooling the adjacent slash face.

7. A turbine bucket as in claim 1, further comprising a plurality of turbulators in at least one of said cavity and said inlet bore for augmenting heat transfer therein.

8. A turbine bucket having an airfoil portion and a root portion with a substantially planar platform at an interface between the airfoil portion and the root portion, a platform cooling arrangement including a cavity extending along the forward portion of the platform, forward of a leading edge of said airfoil portion and continuously from a pressure side to a suction side of said airfoil portion, at least one inlet bore extending from a source of cooling medium to said cavity and at least one outlet opening for expelling cooling medium from said cavity, wherein said at least one outlet opening comprises at least one film hole defined through said platform to communicate said cavity with a low static pressure region on a suction side of the airfoil portion.

9. A method of cooling a leading edge of a turbine bucket having an airfoil portion and a root portion, said airfoil portion being joined to a platform extending over said root portion, comprising:

forming a cavity to extend along and adjacent to at least a portion of said leading edge, forward of a leading edge of said airfoil portion and continuously from a pressure side to a suction side of said airfoil portion;

flowing a cooling medium from a source of cooling medium through at least one inlet bore to said cavity; and expelling cooling medium from said cavity through at least one outlet openings, wherein said at least one exit outlet opening comprises an exit opening at a longitudinal end of said cavity and further comprising directing spent cooling medium from said cavity against an adjacent bucket platform and purging a gap between adjacent platforms with said spent cooling medium.

10. A method as in claim 9, wherein cavity is one of a cast-end cavity, a machined cavity and a drilled hole.

11. A method as in claim 9, wherein said cavity is formed to extend in parallel to a leading edge of said platform.

12. A method of cooling a leading edge of a turbine bucket having an airfoil portion and a root portion, said airfoil portion being joined to a platform extending over said root portion, comprising:

forming a cavity to extend along and adjacent to at least a Portion of said leading edge, forward of a leading edge of said airfoil portion and continuously from a pressure side to a suction side of said airfoil portion;

flowing a cooling medium from a source of cooling medium through at least one inlet bore to said cavity; and expelling cooling medium from said cavity through at least one outlet opening, wherein said at least one outlet opening comprises a plurality of film cooling holes and wherein said expelling includes allowing cooling medium to escape from said cavity through said film cooling holes.

13. The method of claim 12, wherein said film cooling holes are located in said platform.

14. The method of claim 13, wherein said film cooling holes are on a suction side of the airfoil portion.

* * * * *

UNITED STATES PATENT AND TRADEMARK OFFICE

CERTIFICATE OF CORRECTION

PATENT NO. : 7,309,212 B2
APPLICATION NO. : 11/282704
DATED : December 18, 2007
INVENTOR(S) : Itzel et al.

It is certified that error appears in the above-identified patent and that said Letters Patent is hereby corrected as shown below:

In claim 12, at line 35 the word “Portion” should read as “portion”

Signed and Sealed this

First Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,309,212 B2
APPLICATION NO. : 11/282704
DATED : December 18, 2007
INVENTOR(S) : Itzel et al.

It is certified that error appears in the above-identified patent and that said Letters Patent is hereby corrected as shown below:

Column 4, In claim 12, at line 35 the word "Portion" should read as "portion"

This certificate supersedes the Certificate of Correction issued July 1, 2008.

Signed and Sealed this

Twenty-second Day of July, 2008

JON W. DUDAS
*Director of the United States Patent and Trademark Office*